US010000899B1

(12) United States Patent
Fabry et al.

(10) Patent No.: US 10,000,899 B1
(45) Date of Patent: Jun. 19, 2018

(54) FIRE PROTECTION DEVICE FOR A STRUCTURAL CABLE

(71) Applicant: SOLETANCHE FREYSSINET, Rueil Malmaison (FR)

(72) Inventors: Nicolas Fabry, Antony (FR); Romain Guicheteau, Paris (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days. days.

(21) Appl. No.: 15/837,284

(22) Filed: Dec. 11, 2017

(30) Foreign Application Priority Data

Dec. 19, 2016 (EP) ..... 16306729

(51) Int. Cl.

| | |
|---|---|
| ***E01D 11/00*** | (2006.01) |
| ***E01D 19/16*** | (2006.01) |
| ***E04B 1/94*** | (2006.01) |
| *E01D 11/04* | (2006.01) |

(52) U.S. Cl.
CPC ..... *E01D 19/16* (2013.01); *E04B 1/944* (2013.01); *E01D 11/04* (2013.01)

(58) Field of Classification Search
CPC ..... E01D 19/16; E01D 11/04; E04B 1/944
USPC ..... 14/18–22, 78
See application file for complete search history.

(56) References Cited

U.S. PATENT DOCUMENTS

2008/0121151 A1 5/2008 Hallissy et al.

FOREIGN PATENT DOCUMENTS

| | | |
|---|---|---|
| JP | 2011064010 | 3/2011 |
| WO | 2007/093703 A2 | 8/2007 |
| WO | 2007/093703 A3 | 8/2007 |
| WO | 2012/052796 A1 | 4/2012 |

*Primary Examiner* — Raymond W Addie
(74) *Attorney, Agent, or Firm* — Dentons US LLP

(57) ABSTRACT

A fire protection device for a structural cable is proposed including taught metal reinforcements (32) and having a first stretch (41), a second stretch (42) and a connection zone (40) of a collar (30) located between the first and second stretches. The fire protection device comprises a protective mat (34) surrounding the structural cable (16) in the first and second stretches (41, 42) and interrupted in the connection zone (40), and a thermally insulating ring (36) more rigid than the protective mat (34), arranged between the reinforcements (32) and the collar (30) in the connection zone (40) and cooperating with the protective mat in order to provide the reinforcements with a continuous thermal protection along the first stretch (41), of the connection zone (40) and of the second stretch (42).

15 Claims, 2 Drawing Sheets

FIG. 1
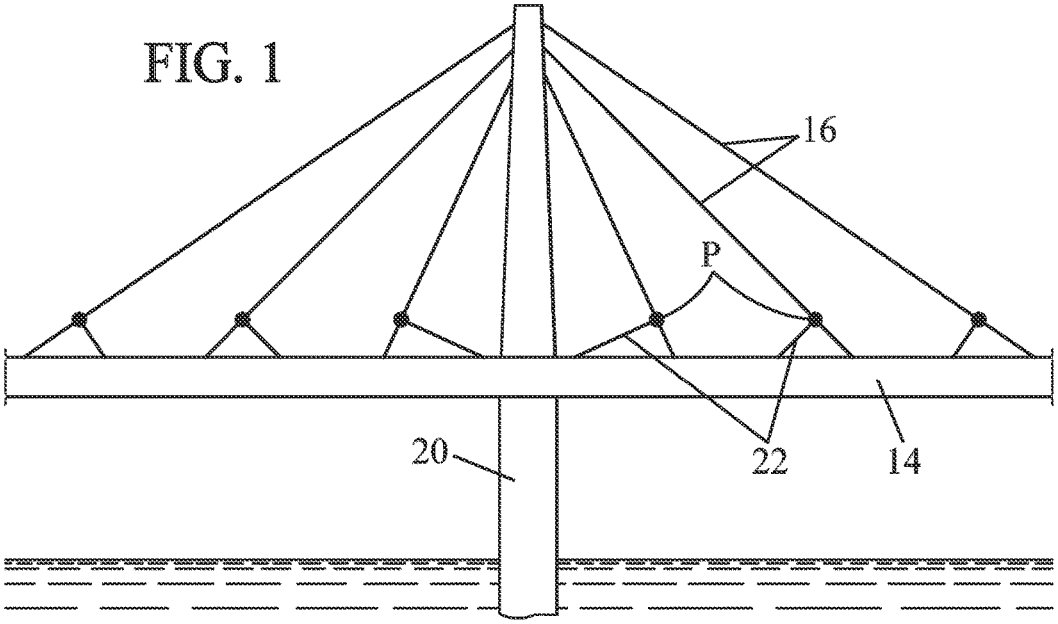
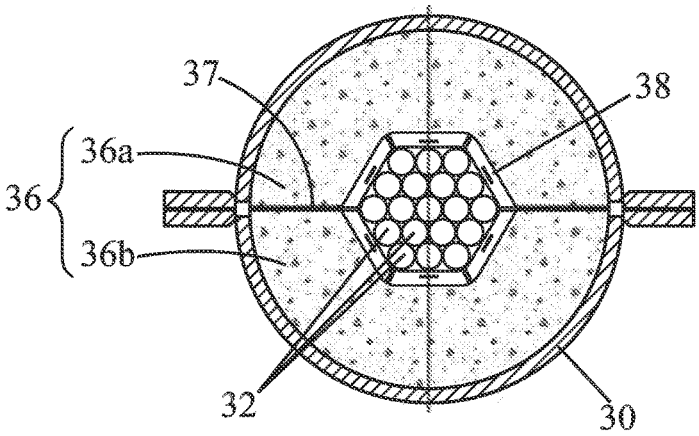
FIG. 3

FIRE PROTECTION DEVICE FOR A STRUCTURAL CABLE

This invention relates to the fire protection of cables having a structural role in construction works, in particular works that have stayed or suspended portions or rigidified with cables.

BACKGROUND

One of the major risks for a cable structure in the operating phase is fire, in particular of a vehicle, in particular in the vicinity of a cable securing zone, for example on a causeway.

A structural cable of such a work comprises taught metal reinforcements in order to transmit the forces required between its ends. The reinforcements are for example metal strands possibly contained in individuals sheathes made of plastic material. The harness of metal reinforcements is often surrounded by a collective sheath made of plastic material which provides the cable with aerodynamic properties, an aesthetic aspect and/or an anti-vandalism function.

WO 2007/093703 A2 describes a fire protection system comprising a mat comprised of a flexible insulating material that directly surrounds the reinforcement harness of the cable and which is contains in the collective sheath.

This system has for limitation not making it possible to effectively protect the cable in certain singular points where it interacts with other members of the structure. For example, if a deviator or a damper is applied against the cable, the presence of the flexible material of the mat prevents good communication of the forces and good operation of this member.

Singular points of this type are often present in the vicinity of the anchorings of the cables. This is the case for example for installing dampers of stay cables. Examples are described in EP 0 343 054 A1 and WO 2015/059413 A1.

These singular points are weak points of the fire protection.

In case of fire, the priority is to protect the reinforcement harness of the cable, even if peripheral equipment has to be replaced such as a damper or a deviator.

A difficulty is that the fire protection of singular points where peripheral equipment is connected must not decrease the correct operation thereof during the normal operation of the structure. For example, a damper or deviator collar must offer a sufficiently rigid point of support between the cable itself and the damping or deviator device. This constraint can contradict the implementation of good fire protection solutions, in particular those implementing a flexible mat surrounding the reinforcements of the cable. This mat passing through a collar would constitute a flexible interface, that decreases, for example, the performance of a cross damper anchored on this collar. Typically, the value of the transverse rigidity, in any direction orthogonal to the longitudinal axis of the cable, of the collar is never less than $10^6$N/m (100 kgf/mm) and advantageously greater than $10^8$N/m (10 tf/mm).

A purpose of this invention is to propose another method of protection capable of overcoming at least partially the difficulties hereinabove.

SUMMARY

A device for the fire protection of a structural cable of a construction work is proposed, the structural cable comprising taught metal reinforcements and having a first stretch, a second stretch and a connection zone of a collar located between the first and second stretches. The fire protection device includes:

- a protective mat surrounding the structural cable at least in the first and second stretches and interrupted in the connection zone; and
- a thermally insulating ring more rigid than the protective mat, arranged between the reinforcements and the collar in the connection zone and cooperating with the protective mat in order to provide the reinforcements with continuous thermal protection along the first stretch, the connection zone and the second stretch.

The devices procure auxiliary protection at the singularities that form the connection zones of collars while still protecting the reinforcement harness by a protective mat on either side of such connection zones.

The continuity of the protection prevents the thermal bridges that would be able to transmit the heat released by a fire in the vicinity of the cable to the metal reinforcements.

The fire protection can be limited to a zone adjacent to an anchoring of the cable, or extend over the entire length of the cable, according to the risk of fire to be taken into consideration for the work.

In an embodiment, the insulating ring comprises several elements assembled around reinforcements, in mutual contact along surfaces lined with a firebreak seal.

A deviator tube made of plastic material can be placed between the insulating ring and the reinforcements in the connection zone.

A fibre-reinforced concrete can be used, among other materials, to carry out the insulating ring. The fibre-reinforced concrete can include metal fibres and polypropylene fibres The protective mat can be comprised of several segments arranged end-to-end in at least one of the first and second stretches of the structural cable, with an overlay mat being placed around two adjacent segments in order to ensure the continuity of the thermal protection.

In order to ensure the continuity of the thermal protection on either side of the connection zone, the protective mat can be placed longitudinally in contact with the insulating ring on the side of the first stretch and on the side of the second stretch.

It can also be provided that the protective mat has a portion that has a longitudinal overlay with the thermally insulating ring, reinforcements and the thermally insulating ring.

Another possibility, which can also supplement the preceding ones, is to have an intumescent material at the interface between the protective mat and the insulating ring on the side of the first stretch and on the side of the second stretch.

An embodiment of the fire protection device further comprises, in at least one of the first and second stretches, a tube wherein the reinforcements of the structural cable are housed, with the protective mat being arranged around this tube.

In a typical embodiment, the insulating ring has a rigidity at least 100 times greater than that of the protective mat.

Another aspect of the invention relates to a construction work comprising at least one structural cable and a collar connected to the structural cable in a connection zone. The structural cable comprises taught metal reinforcements and a first stretch and a second stretch on either side of the connection zone of the collar. The construction work further comprises a fire protection device including:

a protective mat surrounding the structural cable at least in the first and second stretches; and a thermally insulating ring more rigid than the protective mat, arranged between the reinforcements and the collar in the connection zone and cooperating with the protective mat in order to provide the reinforcements with a continuous thermal protection along the first stretch, the connection zone and the second stretch.

According to an embodiment of the work, the structural cable further comprises an outer sheath surrounding the reinforcements and the protective mat in at least one of the first and second stretches.

The collar can have for function to provide a connection of at least one damper element to the structural cable in order to dampen the vibrations of the structural cable.

The construction work can in particular consist in a cable-stayed bridge, an extradosed bridge, a suspension bridge or a cable-stayed tower.

BRIEF DESCRIPTION OF THE DRAWINGS

Other particularities and advantages of this invention shall appear in the description hereinafter of a non-limiting example of an embodiment, in reference to the annexed drawings, wherein:

FIG. 1 is a diagrammatical profile view of a cable-stayed bridge;

FIG. 3 is a transverse section of the stay cable on the collar.

DESCRIPTION OF EMBODIMENTS

Figure 2:
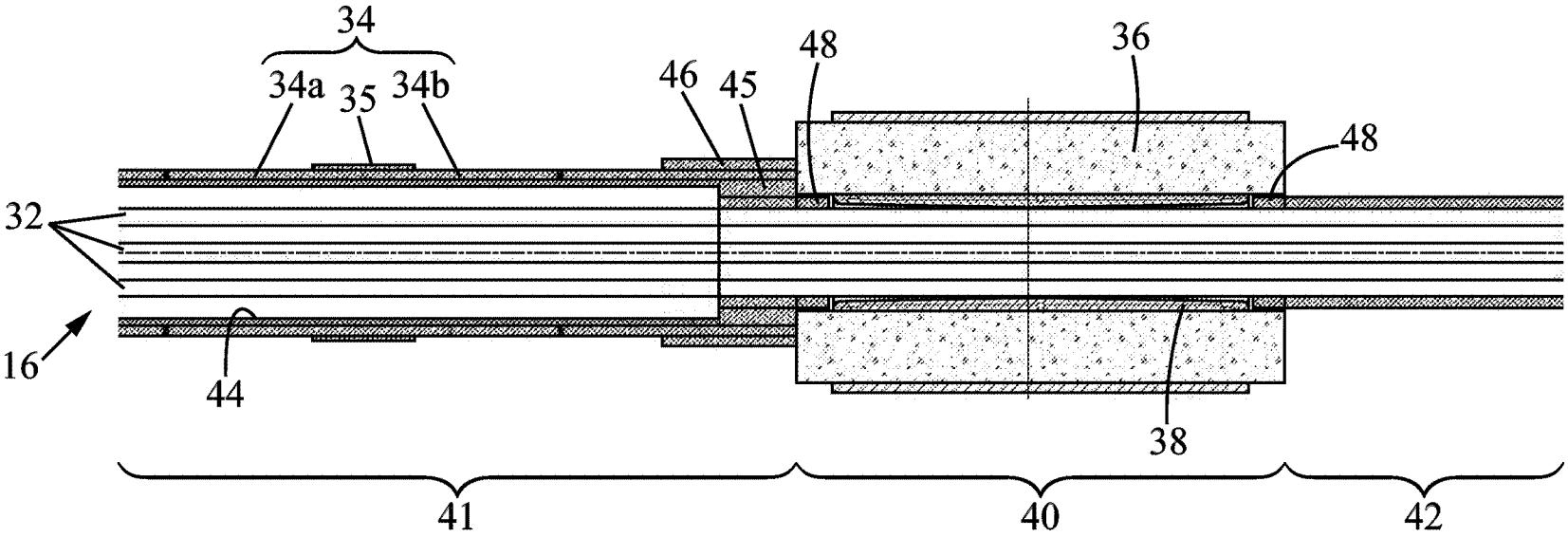
FIG. 2 is an axial cross-section view of a stay cable in the vicinity of a connection collar of a damping device.

The invention is described hereinafter in its non-limiting application to cable-stayed bridges. It is understood that it can also be applied in extradosed bridges, suspension bridges or cable-stayed towers. The structural cables that are to be protected from fire can also be outer pre-stressed cables of works made of concrete.

In the example of FIG. 1 the structural cables considered 16 are the stay cables of a bridge that extend between a pylon 20 of the bridge and its deck 14 in order to suspend the deck 14.

One or several stay cables 16 are provided with a damping device 22 comprising an arm that extends transversally to the stay cable 16 between an attaching point P located in the vicinity of the low anchoring thereof (for example at a few % points of the total length of the stay cable) and the deck 14.

To connect the arm of a damping device 22 to its stay cable 16 at point P, use is made of a collar 30 such as the one shown in FIGS. 2 and 3.

A similar collar can be used to connect the structural cable to a fixed deviator (without damper) through which it bears, for example, on a stayed structure or a stay pylon. Another example of application is for a hanging collar located in the vicinity of the deck of a suspension bridge. When a hanging collar is at a height less than about 10 m, even up to 18-20 m, it can be affected by a vehicle fire, in such a way that the measurements described hereinafter can advantageously be adopted.

The structural cable that forms the stay cable 16 comprises a harness of metal reinforcements 32, which are stretched between two anchoring devices (not shown) arranged at its ends, one on the deck 14 and the other on the pylon 20. The reinforcements 32 are for example strands, in particular strands that are individually sheathed and greased or waxed.

In the main portion of the stay cable 16, the reinforcements 32 are protected from fire by a flexible protective mat 34, which can, for example, be formed in a similar way, in particular with the same materials as the one described in WO 2007/093703 A2. The mat 34 can extend over the entire length of the stay cable, or only over a portion of the latter if the fire protection is not required over the entire length.

FIG. 2 shows the connection zone 40 of the collar 30, which is located between a first stretch 41 and a second stretch 42 of the stay cable 16. Each stretch 41, 42 extends from the connection zone 40 either to an anchoring of the stay cable, or to another singular point, or to a point of the main portion starting from which the protective mat is no longer required.

The protective mat 34 surrounds the stay cable 16 in the first and second stretches 41, 42, and it is interrupted in the connection zone 40. Indeed, the flexibility of the mat 34 is not necessarily suitable for the function of the equipment connected to the stay cable 16 via the collar 30. A more rigid interaction is typically required at this level.

For this, a ring 36, is more rigid than the protective mat 34 (K time more rigid with $K \geq 100$ for example, even $K \geq 10{,}000$), is arranged between the reinforcements 32 and the collar 30 in the connection zone 40. The rigidity of the insulating ring 36 can be greater than $10^6$N/m, or even $10^8$N/m.

The ring 36 is also used to prevent the thermal bridges between the metal reinforcements of the stay cable 16 and the collar 30. It is thermally insulating and cooperates with the protective mat 34 in order to provide the reinforcements with continuous thermal protection all along the first stretch 41, of the connection zone 40 and of the second stretch 42.

The insulating ring 36 can be made from a fibre-reinforced concrete, in particular a fibre-reinforced concrete with ultra-high performance (UHPC). The fibres that make up the composition of the fibre-reinforced concrete can include metal fibres and polypropylene fibres. The metal fibres improve the mechanical strength of the ring 36, while the polypropylene fibres improve the resistance thereof in the event of an increase in the temperature, by limiting weakening caused by spalling.

The insulating ring 36 is manufactured in several moulded elements 36*a*, 36*b* which are then assembled around the reinforcement harness 32. In the example shown in FIG. 3, the ring 36 is comprised of two moulded half-shells 36*a*, 36*b* assembled around reinforcements 32. A firebreak seal 37 is placed on the surfaces of mutual contact of the two moulded half-shells 36*a*, 36*b*.

It is desirable to prevent contact of the concrete on the metal reinforcements 32 of the stay cable. For this, a deviator tube 38 is inserted between the ring 36 and the reinforcement harness 32. The tube 38 is made of plastic material, for example a high density polyethylene (HDPE). It has a toric geometry on its inner face in order to accommodate small deviations that the reinforcement harness 32 is subjected to at the collar 30. If the reinforcement harness 32 has a polygonal transverse section (hexagonal in the case of FIG. 3), the deviator tube 38 can be formed by arranging several plates made of plastic material against the faces of the harness before setting the elements 36*a*, 36*b* of the ring 36 into place.

The left portion of FIG. 2 shows that as an option, a tube 44 can be provided that contains the reinforcement harness 32 and which is surrounded by the protective mat 34. This tube 44, for example made of HDPE, adds an air gap between the reinforcements 32 and the mat 34 and, in this way, further increase the thermal protection of the reinforcements in the event of fire. Such a tube can be present in one of the stretches 41, 42, or in both.

In order to cover a sufficient length along the stay cable 16, it is generally necessary to install end-to-end several segments 34*a*, 34*b* of the protective mat 34 in at least one of the stretches 41, 42 (FIG. 2). In order to ensure the continuity of the fire protection in the main portion of the stay cable, an overlay mat 35 is placed around two adjacent segments 34*a*, 34*b* in such a way as to entirely cover the existing seal between them.

The mat 34 is held on the cable 16 using an adhesive or strapping strips, or a combination of these two types of means.

FIG. 2 further shows that the protective mat 34 is placed longitudinally in contact with the insulating ring 36 on the side of the first stretch 41 and on the side of the second stretch 42. A few additional measurements can be taken in order to perfect the continuity of the protection between the connection zone 40 and one or the other of the stretches 41, 42.

In particular, a longitudinal overlay can be arranged between the thermally insulating ring 36 and a portion of the protective mat 34 (FIG. 2). This portion as an overlay 48 of the protective mat 34 is inserted between the reinforcements 32 and the ring 36, in contact with the reinforcement harness 32.

When a tube 44 is present between the reinforcements 32 and the protective mat 34, allowances of the fire protection mat 45, 46 can be added in the vicinity of the ring 36 in order to offset the thickness of the air gap and of the tube 44.

In addition, it is often suitable to coat an intumescent material at the interface between the protective mat 34 and the insulating ring 36. In case of excessive heating, this material swells in order to prevent the conducting of the heat in the direction of the reinforcements 32.

The flexible fire protection mat arranged on either side of the collar 30 and of the insulating ring 36 will generally not be directly exposed to the open air. It will be covered by a tubular sheath (not shown) comprised either of a steel tube, for a plastic sheath (HDPE). This sheath gives the stay cable an aerodynamic and aesthetic profile and mechanically protects the mat.

The embodiments described hereinabove are a simple illustration of this invention. Various modifications can be made without leaving the scope of the invention that emerges from the annexed claims.

The invention claimed is:

1. A fire protection device for a structural cable of a construction work, with the structural cable comprising taught metal reinforcements and having a first stretch, a second stretch and a connection zone of a collar located between the first and second stretches, with the fire protection device including:

a protective mat surrounding the structural cable at least in the first and second stretches and interrupted in the connection zone; and a thermally insulating ring more rigid than the protective mat, arranged between the reinforcements and the collar in the connection zone and cooperating with the protective mat in order to provide the reinforcements with a continuous thermal protection along the first stretch, of the connection zone and of the second stretch.

2. The fire protection device according to claim 1, wherein the insulating ring comprises several elements assembled around reinforcements, in mutual contact along surfaces lined with a firebreak seal.

3. The fire protection device according to claim 1, wherein a deviator tube made of plastic material is placed between, the insulating ring and the reinforcements in the connection zone.

4. The fire protection device according to claim 1, wherein the insulating ring is made from a fibre-reinforced concrete.

5. The fire protection device according to claim 4, wherein the fibre-reinforced concrete includes metal fibres and polypropylene fibres.

6. The fire protection device according to claim 1, wherein the protective mat is comprised of several segments arranged end-to-end in at least one of the first and second stretches of the structural cable, with an overlay mat being placed around two adjacent segments in order to pride the continuity of the thermal protection.

7. The fire protection device according to claim 1, wherein the protective mat is placed longitudinally in contact with the insulating ring on the side of the first stretch and on the side of the second stretch.

8. The fire protection device according to claim 1, wherein the protective mat has a portion that has a longitudinal overlay with the thermally insulating ring, between the reinforcements and the thermally insulating ring.

9. The fire protection device according to claim 1, wherein an intumescent material is arranged at the interface between the protective mat and the insulating ring on the side of the first stretch and on the side of the second stretch.

10. The fire protection device according to claim 1, further comprising, in at least one of the first and second stretches, a tube wherein are housed the reinforcements of the structural cable, with the protective mat being arranged around said tube.

11. The fire protection device according to claim 1, wherein the insulating ring has a rigidity at least 100 times greater than that of the protective mat.

12. A constuction work comprising at least one structural cable and a collar connected to the structural cable in a connection zone, the structural cable comprising taught metal reinforcements and having a first stretch and a second stretch on either side of the connection zone of the collar, with the construction work further comprising a fire protection device including:

a protective mat surrounding the structural cable at least in the first and second stretches; and a thermally insulating ring more rigid than the protective mat, arranged between the reinforcements and the collar in the connection zone and cooperating with the protective mat in order to provide the reinforcements with a continuous thermal protection along the first stretch, from the connection zone and of the second stretch.

13. The construction work according to claim 12, wherein the structural cable further comprises an outer sheath surrounding the reinforcements and the protective mat in at least one of the first and second stretches.

14. The construction work according to claim 12, wherein the collar provides a connection of at least one damper element to the structural cable in order to dampen vibrations of the structural cable.

15. The construction work according to claim 12, comprised of a cable-stayed bridge, an extradosed bridge, a suspension bridge or a cable-stayed tower.

* * * * *